United States Patent [19]

Chezem

[11] 4,163,574

[45] Aug. 7, 1979

[54] DOOR STOP FOR INWARD OPENING DOOR

[76] Inventor: Jimmie A. Chezem, Rte. 9, Box 164A, Sparta, Tenn. 38583

[21] Appl. No.: 887,671

[22] Filed: Mar. 17, 1978

[51] Int. Cl.[2] ..... E05C 3/12

[52] U.S. Cl. ..... 292/338; 292/DIG. 15

[58] Field of Search ..... 16/86 A, 86 C, 82, 86 R; 292/338, DIG. 15

[56] References Cited

U.S. PATENT DOCUMENTS

| | | | |
|---|---|---|---|
| 3,731,341 | 5/1973 | Woodruff | 292/338 X |
| 3,737,186 | 6/1973 | Chezem | 292/338 |
| 3,809,419 | 5/1974 | Chezem | 16/86 A |

*Primary Examiner*—George H. Krizmanich
*Attorney, Agent, or Firm*—Clarence A. O'Brien; Harvey B. Jacobson

[57] ABSTRACT

An occupant safeguarding door stop for use on the interior surface of the lower edge portion of a sliding door or window or vertically hinged inwardly openable door has a base securely mountable on the interior surface of the door in a portion thereof adjacent to but above the level of a sliding door or window, or a lower edge portion of the vertically hinged door. A rigid leg member aligned with the base is pivotally joined to the base, and has a foot portion arrangeable for being forcibly pressed and readily actuated toward a gripping portion engaging the overhead frame of a sliding door or window, or a floor associated with the door by foot or hand applied pressure. A torsion spring, and the like, is connected to the base and leg member for biasing the leg member toward a raised position away from the floor, or a lowered position away from the frame of sliding doors/windows, while a locking device mounted on the base selectively engages the leg member and holds same in any one of several gripping positions depending on the distance between the base and/or the floor or the overhead frame. In this manner, precise positioning of the stop on the door becomes unnecessary, and more importantly re-surfacing of the floor or overhead frame of sliding door/windows which may change the distance thereof from a previously installed stop does not require re-positioning of the stop.

3 Claims, 6 Drawing Figures

DOOR STOP FOR INWARD OPENING DOOR

BACKGROUND OF THE INVENTION

1. Field of the Invention

This invention relates generally to an occupant safeguarding door stop or check, and particularly to a stop suitable for use on a vertically hinged inwardly openable door or sliding horizontal doors and/or windows.

2. Description of the Prior Art

My prior U.S. Pat. Nos. 3,737,186 and 3,809,419, issued on June 5, 1973, and May 7, 1974, respectively, disclose occupant safeguarding door stops which permit an occupant of a dwelling to effectively cope with stopping the entrance of unauthorized persons even though the door is in a partially open position. Generally speaking, my prior stops include a base mountable on the lower portion of the inner surface of a vertically hinged door, and have pivotally mounted thereto a rigid leg member which can be pushed as by foot pressure into a position frictionally engaging a floor associated with the door and locked into the floor-engaging, door-retarding position regardless of efforts to manipulate the door in a manner contemplated to release the stop. The same principle applies to horizontally sliding doors/-windows, with bottom member holding overhead to door frame or window frames.

A difficulty encountered with my prior door stops, however, is that the locking mechanisms are somewhat critical of precise mounting of the stop on an associated door or window, and that situations are encountered wherein subsequent to mounting a stop on a door, the surface of the associated floor or overhead door track is varied as by laying vinyl tile over a wood floor, or placing carpeting on the floor, and the like, which causes the distance between the stop and the floor or sliding door frame to vary. Accordingly, the locking mechanism of the stop will not be engaged when the stop is pressed into floor-engaging or overhead frame of sliding door/window, door-stopping position.

SUMMARY OF THE INVENTION

It is an object of the present invention to provide an occupant safeguarding door stop specifically intended for use on both the interior surface of a vertically hinged inwardly openable door and on overhead frames of sliding doors/windows.

It is another object of the present invention to provide an occupant safeguarding door stop which can be used with a multiplicity of doors on various kinds of floors as well as frames of sliding doors/windows.

These and other objects are achieved according to the present invention by providing an occupant safeguarding door stop having: a base securely mountable on an interior surface of an associated inwardly opening door in a position adjacent to but above the level of a lower edge portion of the door or below the upper edge of sliding doors and windows; a rigid leg member aligned with and pivotally joined to the base and having a foot portion arranged for being forcibly pressed and readily actuated toward a gripping position engaging a floor or top of sliding door frame associated with the door by foot or hand applied pressure; a torsion spring connected to the base and the leg member for biasing the leg member toward a raised position away from the floor or overhead door frame; and a locking device mounted on the base for selectively engaging the leg member and holding same in any one of several gripping positions depending on the overhead or floor-engaging, door-stopping angle between the base and the leg member, which angle is a function of the distance between the base of the stop and the overhead sliding door frame or the floor being engaged in order to stop the associated door or window.

The locking device advantageously includes an element pivotally mounted on the base and disposed extending toward the leg member. A plurality of substantially parallel grooves are provided on the leg member in an outwardly disposed surface thereof for selectively receiving the element and retaining the leg member in its overhead frame or floor-gripping, door-stopping position. The exact groove receiving the element is a function of the angle between the base and the leg member in the door or window stopping position, which angle is itself the distance between the base and the floor or upper edge and overhead frame, and the desired deflection of the element.

The leg member preferably extends longitudinally in a direction lateral of the pivot axis thereof, with the base including a lower portion provided with a longitudinal through hole normal to the extent of the leg member and open along one longitudinal side. The leg member has an upper portion spaced from the foot portion thereof and provided with a transversely elongated head pivotally disposed in the through hole, with a neck connecting the head to the remainder of the leg member being disposed in the open side of the through hole provided in the base.

The longitudinal extent of the head is advantageously less than the longitudinal extent of the through hole provided in the base, with the head and hole terminating in alignment at a one of a pair of longitudinal end surfaces partially forming the base. This arrangement leaves a space in the through hole of the base at the other of the end surfaces in which the torsion spring can be disposed. Slots are suitably provided in the base and leg member for receiving ends of the spring in such a manner that the torsion spring biases the leg member in a direction away from its door or window stopping position such that it will pivot around the pivot axis thereof toward a plane substantially parallel to and adjacent the base or overhead frame.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
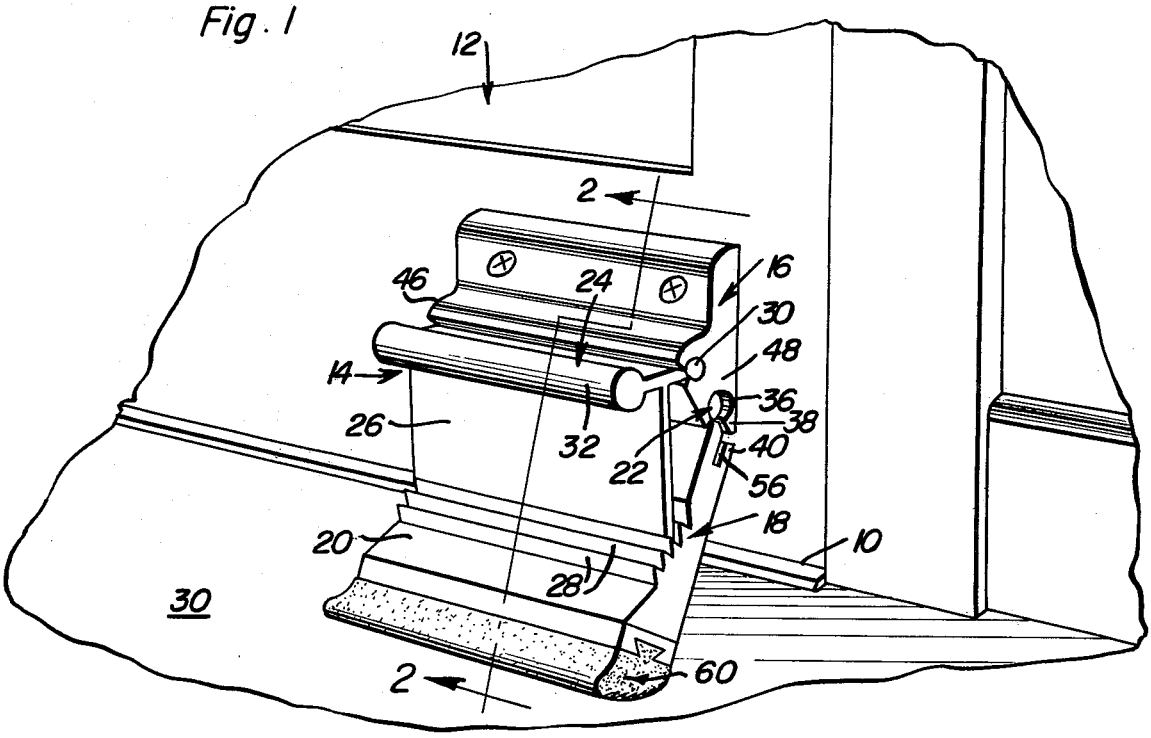
FIG. 1 is a fragmentary, perspective view showing a door stop according to the present invention mounted on the lower edge portion of the inner surface of a vertically hinged door.
Figure 2:
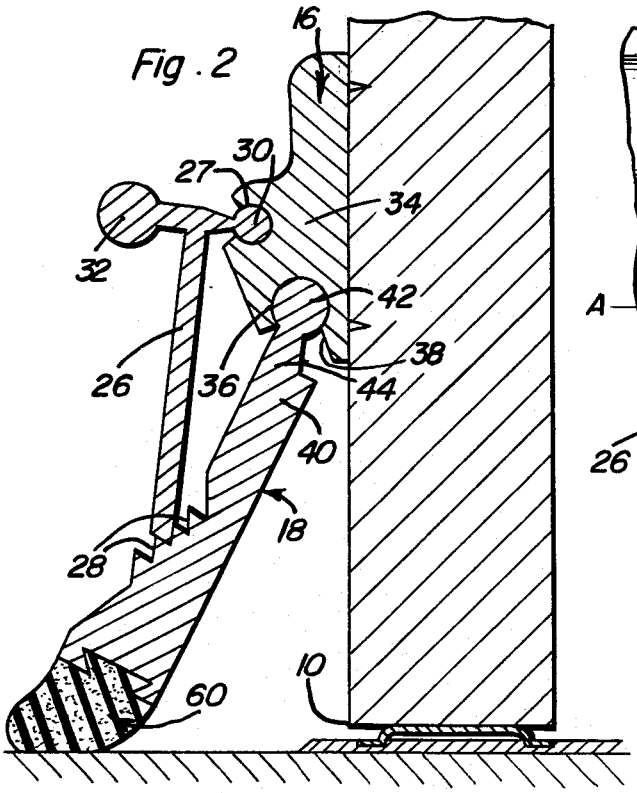
FIG. 2 is an enlarged, fragmentary, sectional view taken generally along the line 2—2 of FIG. 1.
Figure 3:
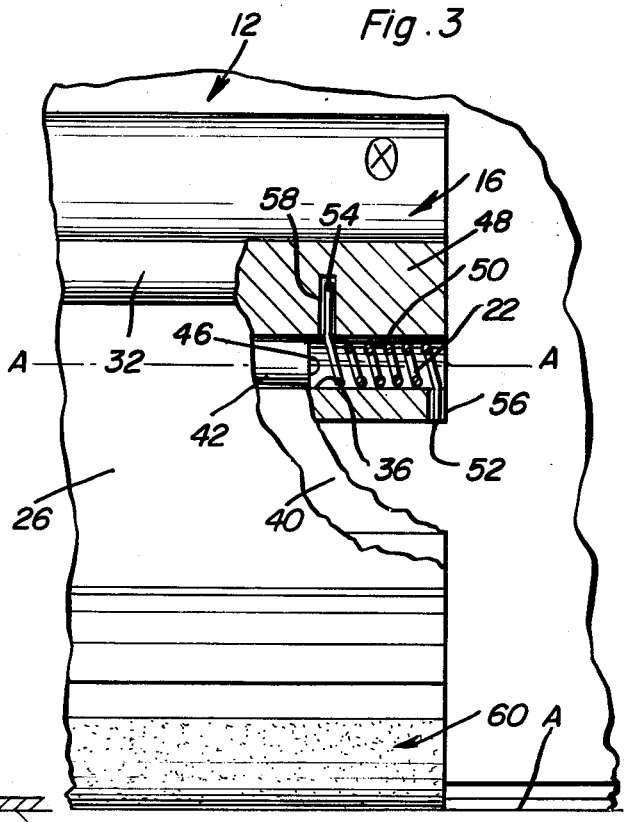
FIG. 3 is an enlarged, front elevational view, partly cut away and in section showing the right-hand half of the door stop illustrated in FIG. 1.

Referring now more particularly to FIGS. 1–3 of the drawings, there is shown mounted on the lower edge portion 10 of the inner surface of a vertically hinged inwardly openable door 12, of conventional construction, an occupant safeguarding door stop 14 according to the invention. This stop 14 includes a base 16 securely mounted on the inner surface of door 12 as by the illustrated screws, and the like, in a position adjacent but above the level of the lower edge portion 10 of door 12. A rigid leg member 18 is aligned with and pivotally joined to base 16, and has a pressure or foot portion 20 arranged for being forcibly pressed and readily actuated toward a gripping position engaging a floor associated with door 12 as by foot-applied pressure in a manner not shown. A coiled torsion spring 22 is connected to base 16 and leg member 18 for biasing leg member 18 toward a raised position away from the aforementioned associated floor.

A locking device 24 is mounted on base 16 for selectively engaging leg member 18 and holding same in any one of several gripping positions depending on the angle between leg member 18 and base 16 when the leg member is in its gripping or door-stopping position. As can be appreciated, this angle will be a function of the distance between base 16 and the associated floor being engaged by the leg member 18.

Preferably, the locking device 24 includes an element 26 in the form of an aluminum extrusion, or the like, formed to suitable configuration and pivotally retained in a suitable partial cylindrical slot 27 provided in the front surface of base 16. In this manner, element 26 extends from base 16 toward leg member 18. A plurality of substantially parallel grooves 28 are provided across the face of leg member 18 so as to be parallel to the pivot axis of member 18 relative to base 16, which pivot axis is defined by the partial cylindrical element 30 disposed in the associated slot 27. These grooves 28 are arranged for selectively receiving the lower end of element 26 and retaining leg member 18 in any one of the several gripping positions. The exact groove receiving the element 26 is a function of the angle between leg member 18 and base 16, which in turn is a function of the distance between base 16 and an associated floor or other abutment surface A. It could also be said that the particular groove 28 receiving element 26 is a function of the desired deflection, or biasing, of element 26.

It will also be appreciated that the element 26 can retain leg member 18 in a desired raised position (not shown) so as to restrain leg member 18 from undesirable upward or raised movement under the influence of spring 22, such that foot portion 20 of leg member 18 would be brought to an awkward position for foot actuation of the stop 14.

A handle 32 is mounted as on the outer surface of element 26 for facilitating manipulation of element 26 relative to the associated grooves 28, and for permitting disengagement of element 26 from a particular groove 28 in order to release stop 14 and permit door 12 to be inwardly opened. As illustrated, handle 32 can be simply a cylindrical element provided with a shank mounted on element 26.

Leg member 18 extends longitudinally laterally of the pivot axis A—A (FIG. 3) thereof, with base 16 including a lower portion 34 provided with a through hole 36 parallel to the pivot axis of leg member 18. This hole 36, the center of which forms the pivot axis A—A, is provided with an opening 38 along one longitudinal side thereof. Leg member 18 has an upper portion 40 spaced from the foot portion 20 and provided with a transversely extending cylindrical head 42 sized for being pivotally disposed in hole 36. A neck 44 connecting head 42 to the remainder of leg member 18 is disposed in opening 38 so as to permit a limited pivotal movement of leg member 18 with respect to base 16. Thus, the upward movement of leg member 18 under the bias of spring 22 is limited by the upper front surface of opening 38, although the raised position of leg member 18 can also be limited by use of locking device 24 as described above.

The longitudinal extent of head 42 is advantageously less than the longitudinal extent of hole 36, with head 42 and hole 36 terminating in alignment at a one of a pair of longitudinal end surfaces 46 and 48. As illustrated in FIG. 3, head 42 terminates at surface 46, with the result that a space 50 is left in hole 36 adjacent the corresponding surface 48. Spring 22 is disposed in the space 50, with the spring ends 52 and 54 of spring 22 being disposed in suitably arranged slots 56 and 58 provided in base 16 and leg member 18, respectively.

Foot portion 20 of leg member 18 is provided along the lower surface thereof with a compressibly resilient floor contacting anti-slipping longitudinal pad 60 which may be attached to leg member 18 as by the illustrated dove-tailed joint. By such a connection of pad 60 to leg member 18, replacement of pad 60 may be easily effected as necessary.

Figure 4:
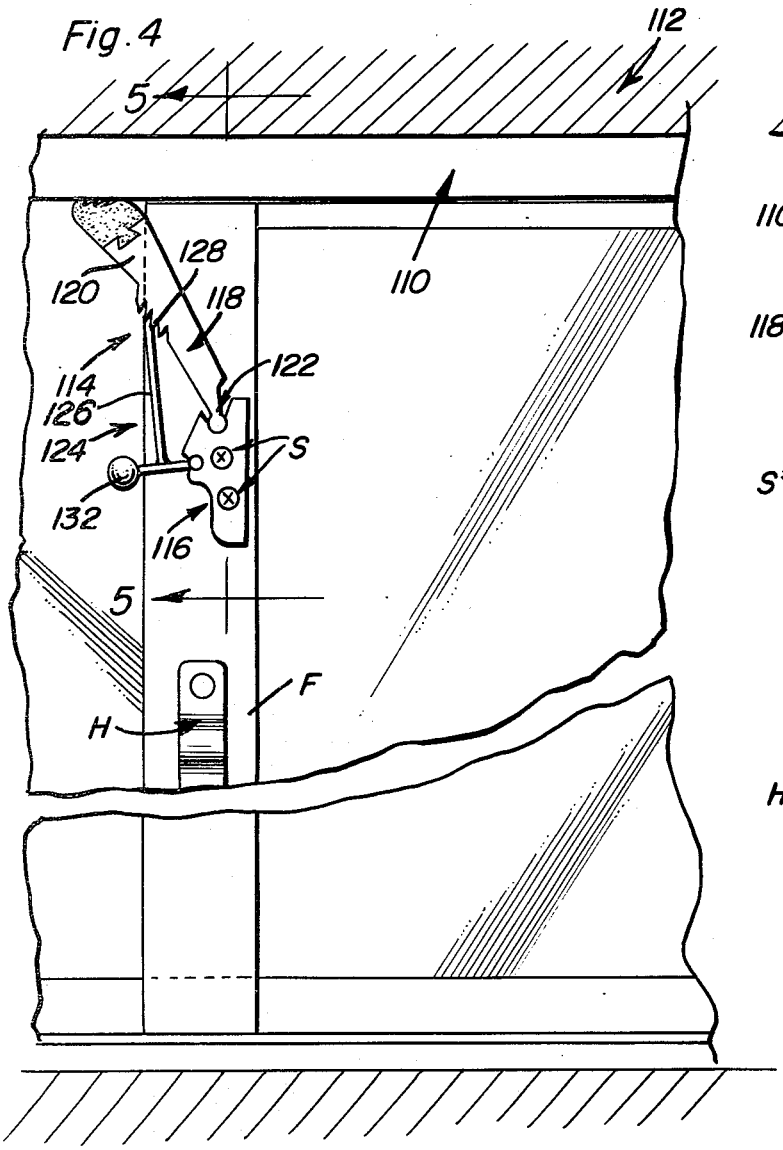
FIG. 4 is a fragmentary, front elevational view, partly in section, showing a door stop according to the present invention and mounted adjacent the upper frame of a horizontally sliding door or window.
Figure 5:
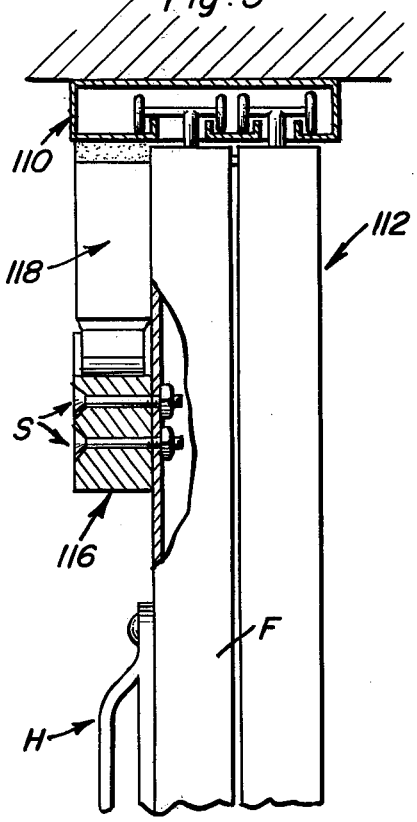
FIG. 5 is a fragmentary sectional view taken generally along the line 5—5 of FIG. 4.

Referring now more particularly to FIGS. 4 and 5 of the drawings, there is shown mounted adjacent the upper frame 110 of a sliding door or window designated generally by the reference numeral 112, which door or window is of conventional construction, an occupant safeguarding door stop 114 according to the present invention. This stop 114 is basically identical in construction to stop 14 described above, but is provided with a base 116 having therein transverse apertures which receive conventional screws S that permit the stop 114 to be mounted on an upright frame member F of the door or window 112 in such a manner that the leg member 118 swings about an axis substantially perpendicular to the associated surface of frame F. A handle H is shown as provided on the frame F for facilitating manipulation of the sliding panel of the window or door 112.

The stop 114 will be engaged and disengaged entirely by hand-pressure when mounted as illustrated in FIGS. 4 and 5, but it is to be understood that such a stop 114 could be mounted adjacent the bottom of a horizontally sliding door or window in a manner not shown if so desired, and in the latter case foot-pressure could be employed for placing the stop in an operating mode.

Figure 6:
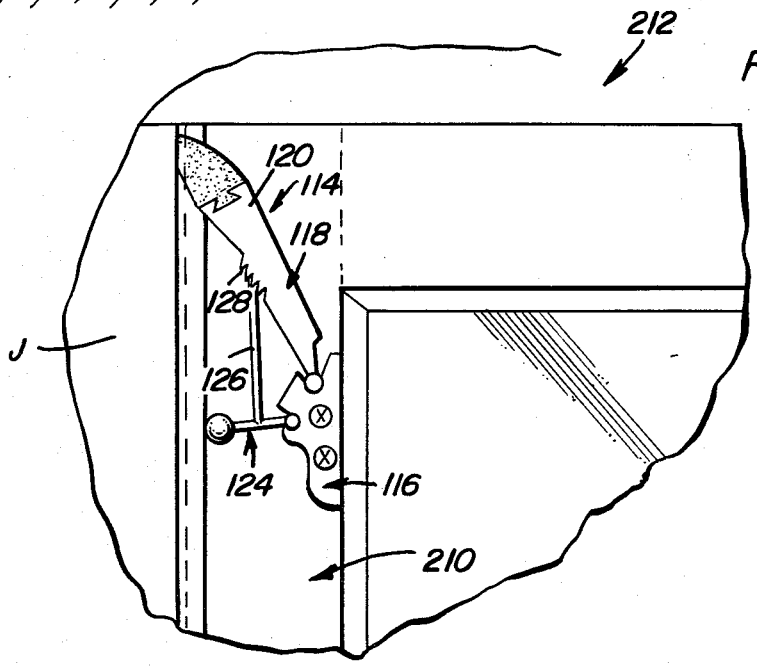
FIG. 6 is a fragmentary, front elevational view showing a door stop according to the present invention mounted on a horizontally sliding window.

FIG. 6 shows the use of the stop 114 according to the invention in conjunction with a horizontally sliding window portion 210, partially forming a window, or other closure, generally designated by the reference numeral 212. When thus arranged, pressure foot portion 120 of the stop 114 will engage against the adjacent surface of a jamb J of the window 212 in order to retain the movable or sliding portion 210 of the window 212 in a desired position.

In operation, leg member 18, 118 will be normally raised from engagement with floor 30, or lowered from engagement of overhead frame 110 or other abutment surface, due to the bias of torsion spring 22, 122. Although the raised position of leg member 18 is not illustrated, it will be appreciated that, as described above, it will be limited either by the locking device 24, 124 or the upper front surface of the opening 38. When it is desired to prevent unauthorized persons, and the like, from opening the window or door, whether the doors be in closed position as shown in the figures of the drawings, or in partially open positions (not shown), an occupant of the dwelling or other structure being protected by stop 14, 114 merely applies foot or hand pressure to portion 20, 120 of leg member 18, 118 in order to overcome the bias of spring 22, 122 and force the leg member 18, 118 into gripping engagement with the abutment surface. As the pressure is slightly released once the gripping engagement is achieved, the free end of resilient element 26, 126 will engage in one of the grooves 28, 128 in order to prevent leg member 18, 118 from being forced out of its door-stopping position by any movement, inward or outward, of door 12 by the unauthorized person attempting entry. When it is desired to release 12, 112, 212 and permit opening and closing thereof, stop 14, 114 can be disengaged merely by the occupant pulling on handle 32, 132 and removing the resilient element 26, 126 from the associated one of the grooves 28, 128. The force of torsion spring 22, 122 will tend to withdraw leg member 18, 118 from the abutment surface in conjunction with, perhaps, a slight movement of 12, 112, 212 in order to break the gripping arrangement between leg element 18, 118 and the abutment surface.

As can be readily understood from the above description and from the drawings, a door stop according to the present invention provides an easily installable and versatile device which does not require precision installation or becomes ineffective when used with overhead door or window frames of a new floor covering, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. For use on the interior surface of a closure, an occupant safeguarding stop including a base securely mountable on an interior surface of an associated closure in a position adjacent but spaced from a jamb of the closure, a rigid leg member including base and free ends and aligned with and having its base end pivotally joined to the base and having a pressure portion on its free end arranged to be forcibly pressed and readily actuated toward a gripping position engaged with an abutment surface associated with the closure, resilient means connected to the base and the leg member for biasing the leg member toward a position displaced away from the abutment surface gripping position, locking means mounted on the base for selectively engaging the leg member and holding the leg member in any one of several gripping positions depending on the angle between the base and the leg member, which angle is a function of the distance between the base and the abutment surface, said locking means including an elongated element having one end pivotally mounted on the base with its other end extending toward the leg member, a plurality of recesses provided on the leg member at points spaced therealong and arranged for selectively receiving a terminal end portion of the other end of said element and retaining the leg member in the gripping position, the exact recess receiving the terminal end portion of the elongated element being a function of the distance between the base and the abutment surface and the desired deflection of the element, said base having a pair of parallel elongated slots formed therein including opposite ends opening endwise outwardly of remote surfaces of said base, said slots including narrow outer longitudinal portions opening laterally outwardly of a side of said base extending between said remote surfaces, the inner portions of said slots being widened and of partial cylindrical configuration, said one end of said elongated element and said base end of said leg member including transverse partial cylindrical portions extending transversely thereof and supported from said element and leg member by narrow neck portions, said element and leg member partial cylindrical portions being lengthwise received in the inner portions of said slots with said neck portions loosely received through said narrow outer slot portions, said leg member partial cylindrical portion including a first end thereof terminating inwardly of the corresponding end of the associated slot, said resilient means including a coil spring disposed within said end of said associated slot and including spring ends engaged with said leg member and base.

2. The combination of claim 1 wherein said recesses include open ended parallel grooves formed in and extending transversely of one side surface of said leg member corresponding to said side of said base outwardly through which said slots open.

3. A structure as defined in claim 1, wherein the free end portion of the leg member is provided with a compressibly resilient abutment surface contacting anti-slipping pad.

* * * * *